US007047862B1

(12) United States Patent
Davis et al.

(10) Patent No.: US 7,047,862 B1
(45) Date of Patent: May 23, 2006

(54) MK38 SMALL CALIBER DEARMER AIMING DEVICE

(75) Inventors: Erik L. Davis, Elkton, MD (US); Dale H. Gjerning, Pomfret, MD (US); Alan L. Gehl, Alexandria, VA (US); Alan Richwald, Newton, NJ (US); Dennis G. Fikejs, Waldorf, MD (US); Richard H. Watkins, Pomfret, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/436,603

(22) Filed: May 9, 2003

(51) Int. Cl.
*F41H 11/12* (2006.01)

(52) U.S. Cl. ..... 89/1.13; 89/14.2

(58) Field of Classification Search ..... 89/1.13, 89/36.06, 14.2, 14.3, 14.6; 42/79, 83, 96
See application file for complete search history.

(56) References Cited

U.S. PATENT DOCUMENTS

| | | | | |
|---|---|---|---|---|
| 1,854,974 | A * | 4/1932 | Bernat | 181/223 |
| 2,466,203 | A * | 4/1949 | Bristow | 42/79 |
| 4,436,017 | A * | 3/1984 | Mohlin | 89/14.3 |
| 5,333,529 | A * | 8/1994 | Brockman | 89/14.3 |
| 5,596,161 | A * | 1/1997 | Sommers | 89/14.2 |
| 6,216,578 | B1 * | 4/2001 | Ledys et al. | 89/14.3 |

FOREIGN PATENT DOCUMENTS

| | | | | |
|---|---|---|---|---|
| EP | 0 178 039 | A2 * | 4/1986 | 89/1.13 |
| FR | 2 680 235 | A1 * | 2/1993 | 89/14.3 |

* cited by examiner

*Primary Examiner*—Stephen M. Johnson
(74) *Attorney, Agent, or Firm*—Fredric Zimmerman

(57) ABSTRACT

The invention, as embodied herein, comprises an aiming device that is attached to the end of the barrel of a dearmer or gun system in order to more quickly and more precisely align the dearmer or gun system with precise, small target. The aiming device also ensures that the dearmer or gun system remains at the minimum standoff distance required without the need to specifically measure the placement.

10 Claims, 1 Drawing Sheet

MK38 SMALL CALIBER DEARMER AIMING DEVICE

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

The present invention pertains to the field of aiming devices, more particularly to end of barrel sighting aiming devices, and most particularly end of barrel sighting aiming devices for small caliber dearming units used to render safe unexploded ordnance (UXO) or improvised explosive devices (IEDs).

2. Description of the Related Art

The military often must dispose of UXO or IEDs such as mines and live ammunition under difficult conditions. In order to safely dispose of UXO or IEDs, the firing train of the explosive must be jammed, removed or interrupted (disrupted) in order to render it safe, thus precluding its detonation or explosive functioning. Most current methods employ a gun type system to drive a low velocity projectile into the fuze mechanism, jamming the firing train components or interrupting/moving the firing train components out-of-line such that they can not function the explosive as designed. The firing train consists of combustible and explosive elements arranged in order of decreasing sensitivity. A fuze explosive train may consist of a primer, a detonator, a delay, a relay, a lead and a booster charge used in combination to generate suitable energy to actuate the main charge. The momentum (velocity and mass dependant) of the projectile must be of a sufficient magnitude to effectively penetrate and disrupt the fuze by move the fuzing train/component(s) out-of-line or to decapitate the fuze from the explosive components without initiating an energetic response in the fuzing/initiation train. As such, the projectile velocity must be minimal enough so the shock delivered by the projectile impacting the explosive fuze does not cause an explosive response in the fuze firing train components. For smaller UXO or IEDs, that are not heavily encased, an MK 38 small caliber dearmer is used by the military in the above described capacity. The MK 38 small caliber dearmer is designed to use either 9 mm or .22 caliber rounds to dearm UXO or IEDs as described above. A standoff of at least the length of the projectile being used is required in order to ensure that the projectile achieves maximum velocity prior to engaging the fuze. The target area for dearmers can be quite small due to having to hit an exact spot on fuzes ranging from one quarter inch to about one inch for small caliber dearmers.

One problem associated with the use of the system described above is due to the standoff requirement and the relative small target area described above. Due to these constraints, it is difficult for an operator to aim the device with the accuracy necessary to render safe the UXO or IEDs. The operator is also normally in a heavy suit, which makes aiming the very narrow barrel of the device even more difficult. Due to the small nature of the MK 38 small caliber dearmer, using a normal electronic sight would be extremely cumbersome. Such sights are also very costly. Also, due to safety concerns, the operator should spend as little time as possible near the unexploded UXO or IED. Thus, any method of reducing aiming time is a significant benefit.

Therefore, an inexpensive, light-weight device that could assist operators in more accurately and more quickly aiming the MK 38 small caliber dearmer is desired.

SUMMARY OF THE INVENTION

The present invention comprises an aiming device that is attached to the end of the barrel of a small caliber dearmer to assist operators in aiming the dearmer more quickly and more accurately. The aiming device of the present invention is inexpensive and light-weight, so it can easily be added to a bomb technician's standard field pack.

Accordingly, it is an object of this invention to provide an aiming device for a small caliber dearmer.

It is a further object of this invention to provide an inexpensive aiming device.

A still further object of this invention is to provide a light-weight aiming device.

This invention accomplishes these objectives and other needs related to aiming devices for small caliber dearmers by providing an aiming device having attaching means to attach the aiming device to the barrel of a dearmer or gun system. Two extensions, approximately opposite one another, extend from the attaching means. The length of these extensions is the minimum standoff for the dearmer or gun system upon which the aiming device will be employed. At the ends of these extensions, two more extensions extend at an angle to create an almost V-shape. The aiming device is attached to the end of the barrel of the dearmer or gun system. In order to align the system, the V-shaped extensions are aligned with the periphery of the target. The V-shaped extensions are pushed toward the target until both extensions are against the target, with the "V". This aligns the dearmer or gun system with the direct center of the target. The angle, the length of the two extensions extending from the attaching means, and the distance between these extensions assist in ensuring that the target remains at least at the minimum standoff requirement for the dearmer or guns system.

BRIEF DESCRIPTION OF THE DRAWINGS

The accompanying drawings, which are incorporated in and constitute a part of the specification, illustrate embodiments of the invention, and, together with the description, serve to explain the principles of the invention.

DESCRIPTION OF THE PREFERRED EMBODIMENT

The invention, as embodied herein, comprises an aiming device that is attached to the end of the barrel of a dearmer or gun system in order to more quickly and more precisely align the dearmer or gun system with precise, small target. The aiming device also ensures that the dearmer or gun system remains at the minimum standoff distance required without the need to specifically measure the placement.

In general the aiming device comprises two extensions connected to an attaching means for attaching the aiming device to the barrel of a dearmer of gun system. The two extensions are approximately opposite one another and comprise a length of about the minimum standoff distance for the dearmer or gun system being used. Two further extensions extend from the ends of the initial extensions at an angle from the barrel, again, approximately opposite one another. When the aiming device is attached to the barrel of a dearmer or gun system, one aims the system by placing the two angled extensions around the periphery of the target. The target can be slid along the extensions, toward the barrel, until the target cannot move further. This aims the barrel directly at the center of the target. Due to the angle, the space between the two extensions extending from the attaching means, and the length of those extensions, the end of the barrel of the dearmer or gun system will always remain at least the minimum standoff distance from the target, without the necessity of measuring the distance.

Figure 1:
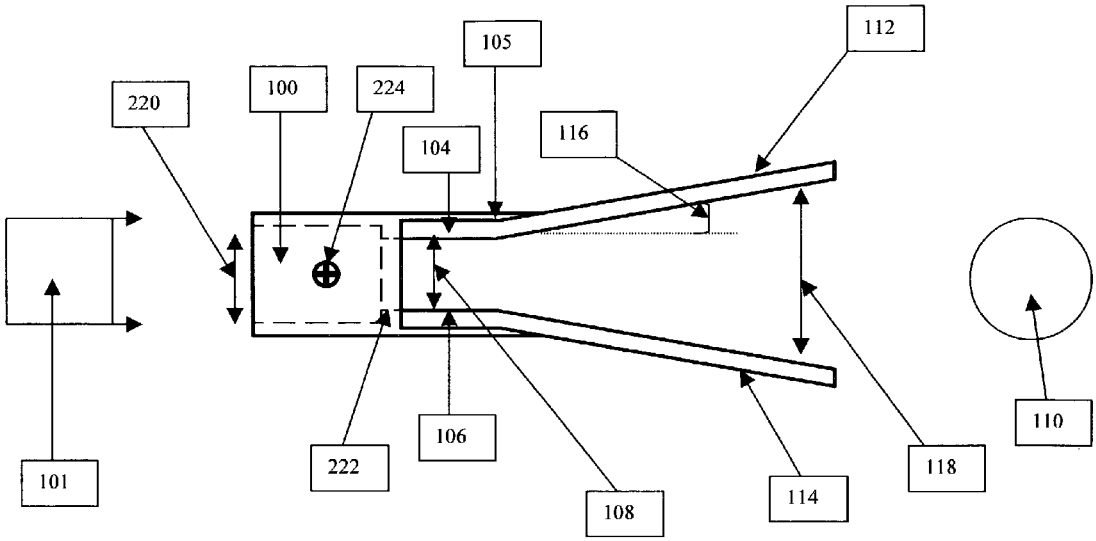
FIG. 1 is a side view of an embodiment of the present invention attached to a dearmer gun system aiming at a fuze target.

Referring to FIG. 1, the invention comprises an attaching means 100 to attach the device to the barrel 101 of a dearmer or guns system. First and second extensions 104, 106 extend from the attaching means 100 and are approximately opposite one another. The length of the first and second extensions 104, 106 is about the minimum standoff distance for the dearmer or gun system being employed. The distance 108 between the first and second extensions 104, 106 is designed to be smaller than the minimum diameter of the target 110. This ensures that the distance between the dearmer or gun system and the target 110 is at least the minimum standoff distance required (length of the first and second extensions 104, 106). Even if the distance 108 is smaller than the minimum diameter of the target 110, a substance (not shown) can be placed across the ends of the first and second extensions 104, 106, such as tape, in order to ensure that the target 110 does not go between the first and second extensions 104, 106 to ensure that the target 110 remains at least the minimum standoff distance from the dearmer or gun system. Any such substance would be selected so as not to interfere with the progress of a projectile leaving the dearmer or gun system. Third and fourth extensions 112, 114 extend from the first and second extensions at an angle 116. The angle 116 is determined based upon the size of the target 110 against which the dearmer or gun system will be employed. Due to the angle 1116, the third and fourth extensions 112, 114 form a V-shape extending from the first and second extensions 104, 106. This V-shape is used in order to align the dearmer or gun system with the target 110 as is described more fully below.

The device can be made of almost any material and a material may be selected by one skilled in the art. One preferred material is plastic due to its light weight and low cost. The dimensions of the device may also be selected by one skilled in the art. The dimensions of the device depend directly upon the dearmer or gun system being employed, as well as the size of the target 110. The invention may be used with almost any type of dearmer or gun system having an extended barrel 101. However, the device was specifically designed to be used with a small caliber dearmer device in order to address specific issues related to that device as described above. As noted above, the length of the first and second extensions 104, 106 are about the minimum standoff distance required for the dearmer or gun system being used.

The distance 108 between the first and second extensions 104, 106 and the angle 116 depend mainly upon the size of the target 110 against which the system is being employed. For the device to operate at maximum efficiency, the distance 108 is less than the diameter of the minimum size of the target 110 in order to ensure that the target 110 does not go between the first and second extensions 104, 106. This ensures that the target 110 remains at least the mimimum standoff distance from the dearmer or gun system. However, the distance 108 must inherently be at least the diameter of the barrel 101. For a small caliber dearmer, the diameter of the barrel 101 is between 0.4–0.5 inches. Therefore, the distance 108 will normally be the same as the diameter. The first and second extensions 104, 106 are connected to the attaching means 100. Any method of connecting may be selected by one skilled in the art that holds the first and second extensions substantially rigid, in place. One preferred connection method is to provide separate extensions 105 molded to the ends of attaching means 100 that can be joined to the first and second extensions through adhesive material or other connection methods. Finally, it is preferred that the first and second extensions 104, 106 be approximately parallel to one another so the extensions 104, 106 do not interfere with the exit of the projectile from the barrel 101.

The third and fourth extensions 112, 114 are attached to first and second extensions 104, 106 and extend at an angle 116 from the barrel 101. The attachment method can be selected by one skilled in the art. When the materials of the entire system are plastic, the preferred attachment method is to mold the first and third extensions 104, 112 and the second and fourth extensions 106, 114 together. The size of the angle 116 depends upon the length of the third and fourth extensions 112, 114, the distance 108 and the diameter of the target 110 and may be determined by one skilled in the art. For a maximum diameter target 110, the ends of the third and fourth extensions 112, 114 should be a distance 118 equivalent to that maximum diameter from one another. This allows both the third and fourth extensions 112, 114 to contact the target 110 to align the barrel 101 with the center of the target 110 as depicted in FIG. 1. For example, when the target 110 comprises a 1 inch maximum diameter, the angle 116 is calculated to provide a distance 118 of one inch. For a small caliber dearmer having an aiming device of about 3 inches in length, such an angle 116 would be about 10 degrees.

Figure 2:
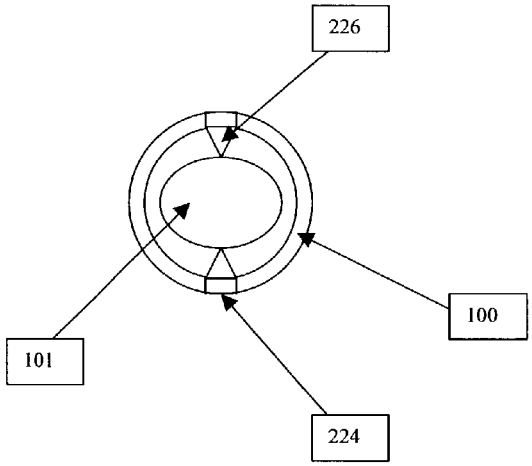
FIG. 2 is front view of the aiming device portion of the embodiment shown in FIG. 1.

The attaching means may comprise numerous methods and devices that may be selected by one skilled in the art. One preferred attaching means is depicted in FIGS. 1 and 2. The attaching means 100 comprising a hollow tube 220 fits over the end of the barrel 101. It is preferred that some type of stopper 222 is present to ensure that the end of the barrel 101 does not protrude through hollow tube 220. The stopper 222 is herein depicted as a molded flap to stop the barrel 101, however, many other embodiments, such as tabs, etc. are possible. The method to affix the hollow tube 220 to the barrel 101 may also be selected by one skilled in the art. One preferred method is depicted in FIGS. 1 and 2. An etched cutout 224 depicting an X-shape would be placed on two sides of the hollow tube 220 approximately opposite one another. When the hollow tube 220 is placed over the barrel 101, the etched cutout 224 would be pushed in so the edges 226 of the cutout 224 would contact the barrel 101 to impede movement. Many variations of this method or other methods could be employed to hold the hollow tube 220 in place upon the barrel 101.

The invention also includes a method of using the device in order to render safe unexploded ordnance. In practice the device operates in the following manner. The invention is placed over the end of the barrel 101 and locked in place using the attaching means 100. The device is positioned so that the plane made by the V-shape of the third and fourth extensions 112, 114 is approximately perpendicular to the target 110. The operator aligns the ends of the V-shape with the target 110 and pushes the V-shape toward the target 110 until the third and fourth extensions both contact the target 110 without in any way bending or deforming the extensions 112, 114. This aligns the barrel 101 with the center of the target 110 and ensures that the target 110 is at least the minimum standoff distance from the barrel 101. The operator finally initiates the dearmer or gun system in order to fire a projectile at the target 110.

What is described are specific examples of many possible variations on the same invention and are not intended in a limiting sense. The claimed invention can be practiced using other variations not specifically described above.

What is claimed is:

1. An aiming device for a gun type system including a barrel, comprising:

attaching means to attach the device to an end of the barrel;

a first extension extending from the attaching means including a length about a minimum standoff distance for the system;

a second extension extending from the attaching means, approximately opposite to the first extension, including a length about the minimum standoff distance for the system;

a third extension extending from the first extension at a first angle from the barrel; and, a fourth extension extending from the second extension at the first angle, approximately opposite to the third extension, wherein a periphery of a target is placed between the third and fourth extensions to align the barrel with a center of the target, and wherein said third extension and said fourth extension are extended from said first extension and said second extension to form a V-shaped configuration in a plane of said third extension and said fourth extension.

2. The device of claim 1, wherein the attaching means comprises a hollow tube placed over the barrel and a mechanism that prevents the hollow tube from movement.

3. The device of claim 1, wherein the attaching means further comprises a front end including a means for preventing the barrel from protruding through the front end.

4. The device of claim 2, wherein the mechanism comprises at least an etched cutout, including edges, and wherein the etched cutout pushed inward results in the edges contacting the barrel to prevent the tube from movement.

5. The device of claim 1, wherein the first extension and the second extensions-comprise positions approximately parallel to the barrel.

6. The device of claim 1, wherein the first angle is about a 10 degrees angle.

7. The device of claim 1, wherein the first extension and the second extension each includes a predetermined length of about 1 inch.

8. A method of rendering safe an unexploded ordnance target, comprising:

providing an aiming device for a dearmer gun system including a barrel, comprising an attaching means to attach the aiming device to an end of the barrel, a first extension extending from the attaching means including a length about a minimum standoff distance for the system, a second extension extending from the attaching means, approximately opposite to the first extension, including a length about a minimum standoff distance for the system, a third extension extending from the first extension at a first angle from the barrel, and a fourth extension extending from the second extension at the first angle, approximately opposite to the third extension;

attaching the aiming device to the barrel of the dearmer gun system;

guiding the target between the third extension and the fourth extension until the target contacts the third extension and the fourth extension; and, initiating the dearmer gun system.

9. The method of claim 8, wherein ammunition for the dearmer gun system is selected from 9 millimeter or .22 caliber ammunition.

10. The method of claim 8, wherein the target comprises a diameter of approximately 1 inch.

* * * * *